United States Patent [19]

Ledebur et al.

[11] 4,037,444

[45] July 26, 1977

[54] SHELL FEED SYSTEM FOR A COLD PILGER MILL

[75] Inventors: Harry Calhoon Ledebur, Canfield; Floyd William Diehl, Jr., Youngstown, both of Ohio

[73] Assignee: Wean United, Inc., Pittsburgh, Pa.

[21] Appl. No.: 758,384

[22] Filed: Jan. 10, 1977

[51] Int. Cl.[2] ..... B21B 37/00; B21B 17/06

[52] U.S. Cl. ..... 72/21; 72/208; 72/214

[58] Field of Search ..... 72/209, 208, 214, 220, 72/7, 21, 252

[56] References Cited

U.S. PATENT DOCUMENTS 3,411,336 11/1968 Wadleck ..... 72/209 X 3,670,549 6/1972 Tselikov et al. ..... 72/214 X

*Primary Examiner*—Milton S. Mehr

*Attorney, Agent, or Firm*—Daniel Patch; Suzanne Kikel

[57] ABSTRACT

A system for incremently and continuously feeding tubes between dies during a prescribed angle of rotation of a crank assembly in a cold pilger mill. As a main motor drives the crank assembly, a servo-motor, receiving a signal from a digital control unit, which receives a signal from a pulsating encoder associated with the main drive, operates to incremently advance a carriage and shell a controlled predetermined distance between the dies. A reversal of the servo-motor returns the carriage to the initial position in preparation to advance another shell.

7 Claims, 2 Drawing Figures

SHELL FEED SYSTEM FOR A COLD PILGER MILL

The present invention relates to a means and control for incremently feeding one or more shells continuously during the reciprocating action of the saddle or stand by a crank assembly in a cold pilger mill.

As is known in the cold pilger mill art, when the throw of the crank reciprocates the die stand, the dies are forced into rolling contact with a section or segment of the tube or shell. In order to index another segment of shell, the shell is fed through open dies at one or both ends of the stroke. In some mills this feeding of the shell with the carriage, as well as the turning of the shell and mandrel are effected during a 120° angle of the rotation of the crank, which with the fast operating speeds of present day mills, allows only a short time period for this to occur. Several feeding mechanisms have evolved to feed segments of shell during this limited period in the different type mills.

One prior feeding method was to employ a gear train arrangement which provided for the changing of gears between a cam and a feed screw, which allows selection of any of several feed lengths as determined by the gear ratios. This system has the disadvantage that it was limited to fixed feed lengths and could not provide for lengths falling between the values attainable with the fixed gear ratios.

Another prior method is described in an article appearing in IRON AND STEEL ENGINEER, August, 1967, page 100, entitled "Tubular Production In The Cold Pilger Machine." In this more recent shell feeding arrangement, several gear trains in conjunction with a main drive crank, and cam arrangement provide for a forward motion of the feed screw for the forward movement of the feed carriage and shell or tube, and an electric remote control unit for reversing the rotation of the gears and for effecting the quick return of the carriage. This method, which is very expensive, provides for any desired length of the tube to be fed within a given range, but involves continuous acceleration and deceleration of many drive and driven components, which are subject to wear and maintenance problems, all of which substantially reduce the efficiency of the feeding system.

Each of the above systems are mechanically complex and expensive since they involve the use of a cam, variable speed drive, several gear drives and a lever associated with one or more feed screws. A separate drive and clutch mechanism is also required to return the feed carriage to its initial feeding position.

It is, therefore, an object of the present invention to provide for a simple, inexpensive shell feeding mechanism in a cold pilger mill which operates efficiently and quickly in a much shorter time than present mills now make available and decreases substantially the maintenance problems associated with prior complex mechanical systems.

It is another object of the present invention to eliminate the use of many of the specially manufactured components of previous designs, and instead, provide for the use of standard commercial items available on the market.

More particularly the object of the present invention is to provide in combination with a cold pilger mill having repetitive cyclic periods of operation, a feed system for feeding a shell over a mandrel into the mill to be reduced thereby, the improvement to the feed system comprising: feed carriage means; rotatable feed screw means for advancing said carriage means with the shell; a power means for rotating the feed screw means to both advance the feed carriage means from a starting position toward the mill and thereafter to return said carriage means after completing its forward travel; means for producing a signal representative of the cyclic operational characteristics of the mill; and control means for receiving the signal and employing it to control the operation of the power means so that the power means drives the screw means during forward travel of the carriage means to feed the shell into the mill and for thereafter rapidly returning the carriage means to its starting feed position, the control means including means for causing the power means to operate to advance the shell at variable preselected lengths or rates of feed.

A still further object of the present invention is to incremently advance different segments of a shell between the dies, and if preferable, to continuously advance several shells through the mill without shutting down the mill, as is now customary.

Another object is to utilize the present invention on different types of cold pilger reducing mills; that is, a long or short stroke mill.

These objects, as well as other novel features and advantages of the present invention, will be better understood and appreciated when the following description thereof is read along with the accompanying drawings of which:

Figure 1:
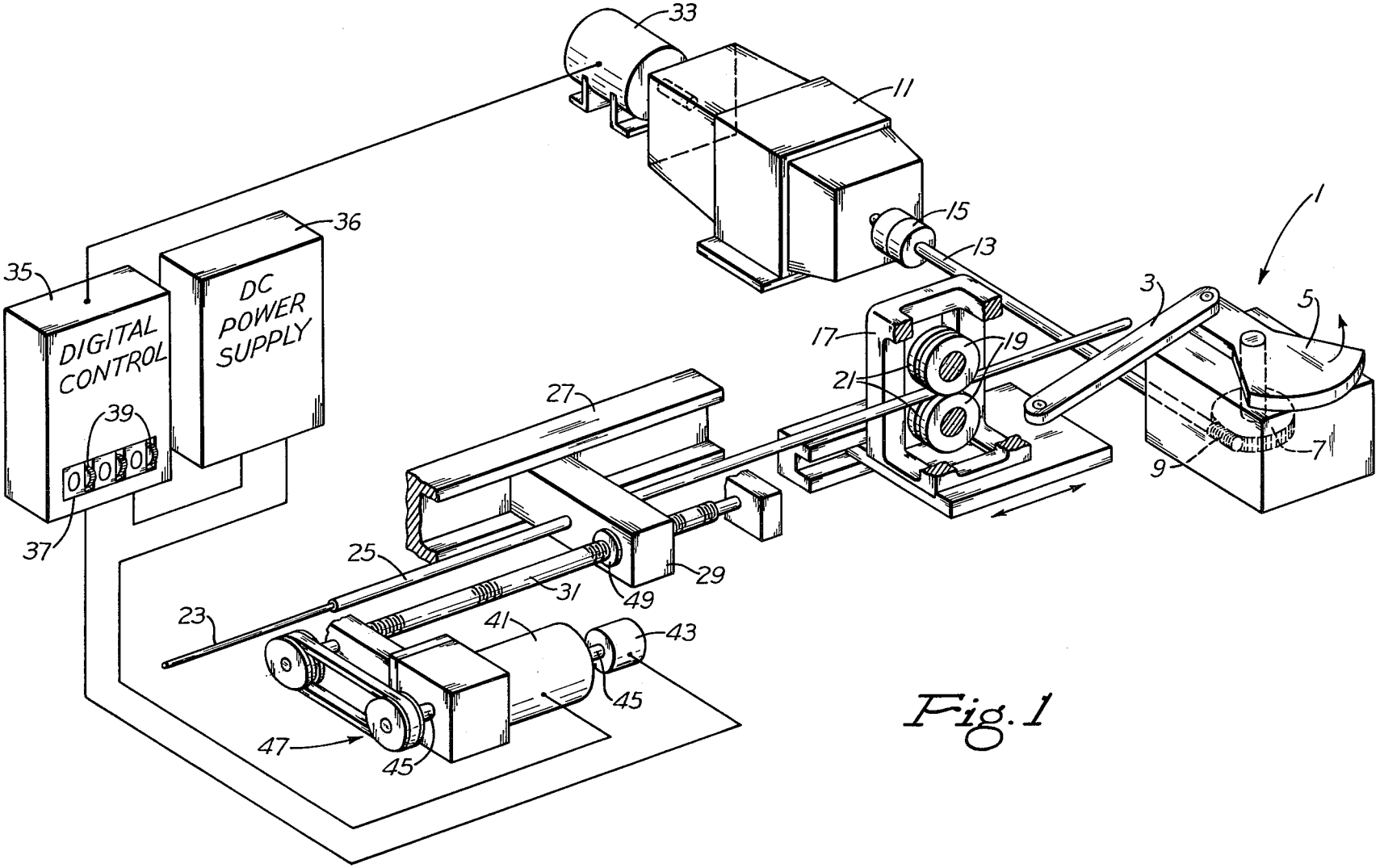
FIG. 1 is a perspective view of a first embodiment of the present invention shown in combination with a single carriage and a well-known type of cold pilger mill.

Referring first to FIG. 1, there is shown a crankshaft assembly 1, having a connecting rod 3, and a shaft 5 with gear 7 meshing with worm gear 9 connected to a main drive motor 11 by shaft 13. To interrupt the torque applied to crankshaft assembly 1 there is provided a clutch 15 located between drive 11 and crankshaft 1. Mounted at one end of connecting rod 3 is a reciprocating saddle 17, broken away in section, and having two dies, which dies rotate within saddle 17 by an intermeshing pinion and rack assembly, not shown, as the saddle is reciprocated by crankshaft assemly 1. As is well known in the art, different working sections of grooves 21 of dies 19 corresponding with different working surfaces of a mandrel 23 reduce the O.D. and I.D. of a segment of a shell 25 to a precise tolerance. In front of saddle 17 is feed bed 27, also broken away in section, supporting a feed carriage 29, which slides on rotation of the screw 31 to advance shell 25 gripped by the feed carriage. The sliding action is easily aided by liners which are not shown. Mandrel rod 23, onto which shell 25 is mounted, extends the entire length of the mill through feed carriage 29 and is supported between dies 19 at one end and gripped by a mandrel lock (not shown) at the other. The operation and construction of most, but not all of the above elements are well known as can be seen from the previously referred to IRON AND STEEL ENGINEER article.

Referring again to FIG. 1, associated with the shaft of the drive motor 11 is an encoder or a transducer 33 which monitors the angle of rotation of the drive motor 11, and therefore, the angle of rotation of crankshaft assembly 1. Encoder 33 which may be of the type manufactured by Astrosystems, Inc., Lake Success, NY, sends a pulsating signal representing the crank rotation to a digital control system 35 which may be a "Hystep" system manufactured by Hyper-Loop, Inc., Bridgeville, ILL. Located at the front of digital control 35 is a window 37 displaying manual or automatic input feed length setting. The control 35 allows for very small or infinite length selection by adjusting thumbwheels 39, if manual operation is employed. To the right of control 35 is a D.C. power supply source 36 which provides power to control 35 and a two-way servo-motor 41. To complete the circuit seen in FIG. 1, digital control 35 is electrically connected to a resolver 43, which is connected to the servo-motor 41. Resolver 43 acts as a feedback system to insure that servo-motor 41 operates correctly in accordance with the signal sent by the control 35. Connected to shaft 45, opposite resolver 43, is a belt-drive system 47 which may be a staple, commercial item having fixed torque and speed characteristics. As can be seen, feed screw 31 is mounted in the drive 47 in a manner to enable the feed screw to remain fixed in fed bed 27, while feed carriage 29, is longitudinally displaced toward and away from saddle 17. An internal threaded nut 49 in carriage 29 provides for this displacement of the carriage while the screw is held axially. To displace feed carriage 29 in the opposite direction away from saddle 17, the direction of rotation of servo-motor 41 is simply reversed. Servo-motor 41 and resolver 43 may also be manufactured by Hyper-Loop, Inc.

A brief description of the operation of the embodiment appearing in FIG. 1 will now be given. Along with passing the shell 25 onto the mandrel rod 23, so that carriage 29 can grip the shell, and activating main drive motor 11, the operator of the mill sets, by thumbwheels 39 of digital control 35, the selected length of a segment of shell to be fed incremently through the mill. Initially, feed carriage 29, is at its starting position adjacent the drive arrangement 47 to receive the shell.

To begin operation of the mill, clutch 15 is engaged to transmit torque to crankshaft assembly 1, which reciprocates saddle 17, and in which the encoder 33 will instantaneously transmit a signal representative of the angular position of crank assembly 1, to control 35. Control 35, in turn, simultaneously sends a signal to resolver 43. Servo-motor 41 receiving its power from supply source 36 operates gear-unit drive 47 to rotate feed screw 31 incremently the pre-selected length of feed for each crank stroke. In this case it is evident that servo-motor 41 operates prior to the forward stroke of the mill although operation could be effected during the return stroke. Once the feed carriage has been displaced its full travel by the screw and the saddle is returned, the shell is released from the carriage and clutch 15 is disengaged to stop crankshaft assembly 1, whereupon servo-motor 41 is reversed by the operator to return the carriage to its starting position adjacent gear-belt drive 47, in preparation for the feeding of another shell.

If it is necessary that this new shell is to be fed at a different incremental length, the operator can by remote control or by adjusting thumbwheels 39, adjust the length setting, in which the new increment of feed length will appear in display window 37. The mill will then resume operation as described above.

It is to be noted that if the feeding of shell is to occur prior to the forward and return strokes of the saddle 17, the control system 35 could be altered to accommodate this particular operation of the mill.

Figure 2:
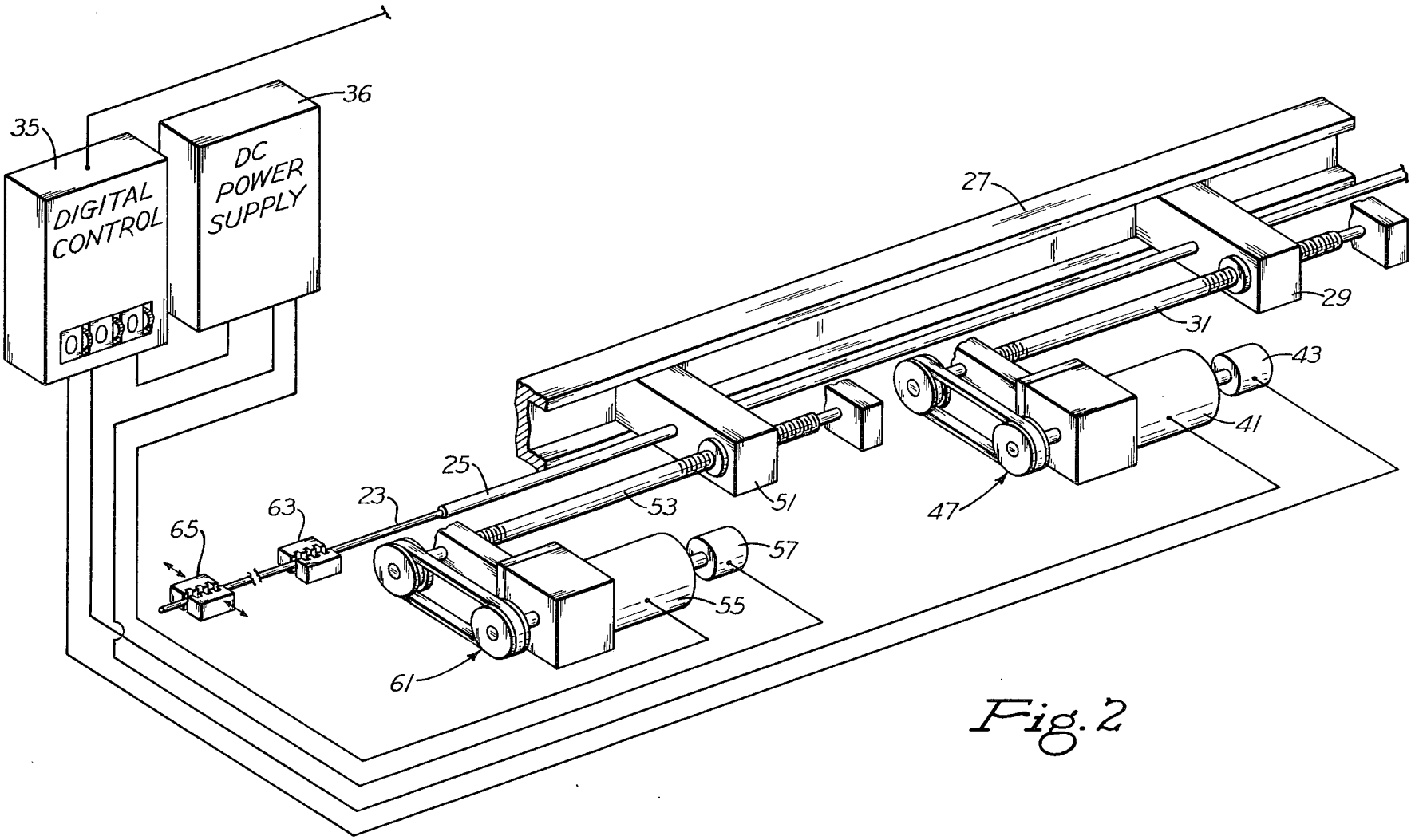
FIG. 2 is a perspective view of a second embodiment of the present invention shown in combination with double carriages for a mill shown in FIG. 1.

Referring now to the second embodiment of the present invention illustrated in FIG. 2, there are two tandem carriages 29 and 51, which arrangement permits succeeding shells to be fed continuously into the dies, thereby eliminating any delay in repositioning the carriage to receive a succeeding shell. In FIG. 2, the reference numbers of FIG. 1 have been used, in addition to the reference numbers corresponding to the additional elements.

As can be seen, digital control 35 and D.C. power supply source 36 are now equipped to transmit signals and power to each of resolvers 43, 57 and servo-motors 41, 55, respectively. Shown in FIG. 2 are two mandrel locks 63, 65 spaced apart at least a distance equal to the length of a shell. These locks 63, 65 are mandatory to grip at all times, the mandrel 23 which is approximately twice as long as the mandrel in FIG. 2, as consecutive shells are fed through the mill.

The operation of the components in FIG. 2 is generally similar to that of FIG. 1. Shell 25 is advanced toward saddle 17 by being gripped alternately in carriages 29 and 51. When carriage 29 is feeding, carriage 51 returns to its starting position, and vice versa.

When the end of shell 25 clears lock 63, the operator releases lock 65 to insert a second shell over the mandrel rod 23, while lock 63 grips the mandrel rod. When the second shell has been completely threaded over the mandrel rod 23, between the two mandrel rod locks, lock 65 is closed and subsequently lock 63 may be opened. The second shell can now be advanced, either by hand or by means of pinch rolls (not shown), until its leading end contacts the trailing end of shell 25, where it is maintained in abutting relationship until gripped by carriage 51 during the normal course of its reciprocal feeding action. Or as shell 25 is ending its travel, the operator may release lock 63 in order to feed the second shell into carriage 51, while lock 65 grips the mandrel. When shell 25 has completed its travel, carriage 29 by servo-motor 41 is returned to a midpoint along the length of the mill. Carriage 51 then travels to a point adjacent the starting position of carriage 29. After the second shell is pushed into carriage 29, carriage 51 is reversed by servo-motor 55 to its starting position, while carriage 29 advances toward the dies 17. From this it can be seen that down time is reduced to a minimum since shells can be advanced one after the other through the mill.

In accordance with the provisions of the patent statutes, we have explained the operation and principles of our invention, and have described and illustrated what we consider to be the best embodiment thereof.

We claim:

1. In combination with a cold pilger mill having repetitive cyclic periods of operation, an improved feed system for feeding a shell into the mill to be reduced thereby, comprising:

feed carriage means, rotatable feed screw means for advancing said carriage means with a shell, a power means for rotating said feed screw means to both advance said carriage means from a starting position toward the mill and thereafter to return said carriage means after completing its forward travel.

means for producing a signal representative of the cyclic operational characteristics of the mill, and control means for receiving said signal and employing it to control the operation of said power means so that said power means drives said screw means during the forward travel of said carriage means to feed the shell into said mill and for thereafter rapidly returning said carriage means to its starting feed position, said control means includes means for causing said power means to operate to advance the shell at variable pre-selected lengths or rates of feed.

2. In a cold pilger mill according to claim 1, wherein said power means comprises a servo-motor and a torque and speed converter having a non-selective power train, and means for connecting said servo-motor to said torque and speed converter and for connecting said torque and speed converter to said feed screw means.

3. In a cold pilger mill according to claim 2, wherein said feed carriage means comprises a single carriage, and wherein said feed screw means comprises a single screw, a screw nut arranged in said feed carriage, and means for mounting said screw so as to prevent axial displacement of said screw.

4. In a cold pilger mill according to claim 1, wherein said signal producing means, comprises:

an encoder connected to the mill for producing a signal representative of the repetitive cyclic periods thereof.

5. In a cold pilger mill according to claim 1, wherein said control means further includes:

a digital control, and a resolver connected to said power means for receiving a signal from said digital control means and for receiving a feed back signal from said power means to coordinate the operation of said power means in a predetermined time sequence with reference to cyclic operation of the mill.

6. In a cold pilger mill according to claim 1, wherein said feed carriage means comprises at least two carriages in tandem, and wherein said feed screw means comprises a feed screw for each carriage, means for restraining movement of said carriages to a predetermined path on one side of said mill, and a mandrel for supporting a shell in the mill, said mandrel arranged on the same side of said mill as said carriages, and being arranged along said path and being of a length equal to twice the length of a shell.

said carriages being constructed and arranged so as to be independently positionable relative to the mill and independently engageable with a succeeding shell, whereby succeeding shells can be fed to the mill without interrupting the operation of the mill.

7. In a cold pilger mill according to claim 6, further comprising:

a pair of mandrel locks spaced along said path a distance approximately equal the length of a shell, and means for causing said locks to independently grip the mandrel in time sequence with the interrelated operations of said carriages in advancing succeeding shells to the mill.

* * * * *